US011376515B1

(12) United States Patent
Livingston et al.

(10) Patent No.: US 11,376,515 B1
(45) Date of Patent: Jul. 5, 2022

(54) TRANSFORMABLE TOY

(71) Applicant: Spin Master Ltd., Toronto (CA)

(72) Inventors: Jessica Livingston, Ottawa (CA); Anne N. Charbonneau, North York (CA)

(73) Assignee: SPIN MASTER LTD., Toronto (CA)

( * ) Notice: Subject to any disclaimer, the term of this patent is extended or adjusted under 35 U.S.C. 154(b) by 0 days.

(21) Appl. No.: 17/362,981

(22) Filed: Jun. 29, 2021

(51) Int. Cl.

| | |
|---|---|
| ***A63H 33/00*** | (2006.01) |
| ***A63H 3/36*** | (2006.01) |
| ***A63H 33/26*** | (2006.01) |
| ***A63H 3/12*** | (2006.01) |

(52) U.S. Cl.
CPC ..... *A63H 33/003* (2013.01); *A63H 3/12* (2013.01); *A63H 3/36* (2013.01); *A63H 33/26* (2013.01)

(58) Field of Classification Search
CPC ..... A63H 33/003; A63H 33/26; A63H 3/36; A63H 3/365; A63H 3/12; A63H 3/48
See application file for complete search history.

(56) References Cited

U.S. PATENT DOCUMENTS

| | | | | | |
|---|---|---|---|---|---|
| 1,387,224 | A * | 8/1921 | Ahler | A63H 3/12 | 446/359 |
| 1,610,724 | A * | 12/1926 | Wilson | A63H 3/12 | 446/359 |
| 1,879,013 | A * | 9/1932 | Arnold | A63H 1/02 | 446/39 |
| 1,985,716 | A * | 12/1934 | Bueschel | A63H 1/06 | 446/241 |
| 2,584,789 | A * | 2/1952 | Clark | B44B 5/022 | 101/7 |
| 2,584,798 | A * | 2/1952 | Goerditz | A63H 3/12 | 446/321 |
| 2,968,121 | A * | 1/1961 | Pearson, Jr. | A63H 37/00 | 403/166 |

(Continued)

FOREIGN PATENT DOCUMENTS

| | | |
|---|---|---|
| CN | 101970069 B | 8/2013 |
| JP | 715701 S | 7/1987 |

(Continued)

OTHER PUBLICATIONS

Prior Art Notice dated Feb. 8, 2022 in connection with Japanese Design Application No. 2021-021624 with English translation—4 pages.

*Primary Examiner* — Eugene L Kim
*Assistant Examiner* — Alyssa M Hylinski
(74) *Attorney, Agent, or Firm* — Aird & McBurney LP

(57) ABSTRACT

In an aspect, a transformable toy is provided and includes a first rotary member and a second rotary member, which are rotatable relative to one another between first and second rotary positions. A projection member is rotationally fixed to the first rotary member, and is movable between a retracted position and an extended position. A helical guide is connected and a helical guide follower are connected to the the second rotary member and the projection member. Relative rotation between the first rotary member and the second rotary member between the first and second rotary positions drives relative rotation between the helical guide and the helical guide follower, which in turn drives the projection member to move between the retracted and extended positions.

11 Claims, 10 Drawing Sheets

(56) References Cited

U.S. PATENT DOCUMENTS 3,032,921 A * 5/1962 Greene ..... A63H 3/48 446/190
4,030,239 A * 6/1977 White ..... A63H 3/48 446/353
4,605,381 A * 8/1986 MacBain ..... A63H 3/12 446/321
4,639,232 A * 1/1987 Wang ..... A63H 1/20 446/241
4,773,889 A * 9/1988 Rosenwinkel ..... A63H 17/262 301/41.1
5,169,354 A * 12/1992 Norton ..... A63H 1/06 446/241
5,893,789 A * 4/1999 Wu ..... A63H 33/00 40/426
5,902,169 A * 5/1999 Yamakawa ..... A63H 3/365 446/337
6,530,499 B1 * 3/2003 Coleman ..... A63H 1/06 221/24
7,306,504 B2 12/2007 Saucier
8,066,542 B2 11/2011 Ejima
8,500,353 B2 * 8/2013 Kim ..... B43K 21/08 401/98
8,500,508 B2 * 8/2013 Yamada ..... A63H 11/00 446/139
8,517,791 B2 8/2013 Yamada
9,868,073 B2 1/2018 Yamada et al.
10,434,400 B2 10/2019 Choi
10,507,398 B2 12/2019 Choi
10,561,957 B2 2/2020 Choi
10,646,790 B2 5/2020 Choi
10,695,687 B2 * 6/2020 Fernandez ..... A63H 33/003
2009/0233519 A1 9/2009 Ejima
2010/0291831 A1 * 11/2010 Yamada ..... A63H 33/003 446/129
2012/0058706 A1 3/2012 Hudson et al.
2012/0309262 A1 * 12/2012 Uehara ..... A63H 3/18 446/391
2015/0050859 A1 * 2/2015 Choi ..... A63F 1/04 446/72
2016/0168127 A1 * 6/2016 Hocutt ..... C07D 513/04 514/395
2016/0361661 A1 * 12/2016 Tiefel ..... A63H 33/003
2018/0147502 A1 5/2018 Choi
2018/0169537 A1 6/2018 Choi
2018/0193760 A1 7/2018 Yamada et al.
2018/0311593 A1 11/2018 Choi
2018/0345158 A1 * 12/2018 Paul ..... A63H 3/365
2019/0168127 A1 6/2019 Fernandez
2019/0224582 A1 7/2019 Fernandez
2019/0236978 A1 * 8/2019 Falls ..... A63H 3/365
2020/0094157 A1 3/2020 Choi

FOREIGN PATENT DOCUMENTS

JP 715702 S 7/1987
JP 5391084 B2 1/2014

* cited by examiner

TRANSFORMABLE TOY

FIELD

The specification relates generally to transformable toys and more particularly to transformable toy that can be rolled when in a first state.

BACKGROUND OF THE DISCLOSURE

It is known to construct transformable toy such as those sold under the Bakugan® brand, by Spin Master Ltd. While such toys provide entertainment for a player it would be advantageous to be able to provide a toy that had enhanced capability for additional play value.

SUMMARY OF THE DISCLOSURE

In one aspect, there is provided a transformable toy which includes a first rotary member and a second rotary member. The first and second rotary members are rotatable relative to one another between a first rotary position and a second rotary position. The transformable toy further includes a projection member that is rotationally fixed to the first rotary member, and is movable between a retracted position and an extended position relative to the first rotary member. The transformable toy further includes a helical guide that is connected to one of the second rotary member and the projection member, and a helical guide follower that is connected to the other of the second rotary member and the projection member. Relative rotation between the first rotary member and the second rotary member between the first and second rotary positions drives relative rotation between the helical guide and the helical guide follower, which in turn drives the projection member to move between the retracted and extended positions.

In another aspect, there is provided a transformable toy which includes a first rotary member and a second rotary member. The first and second rotary members are rotatable relative to one another between a first rotary position and a second rotary position, and between the second rotary position and a third rotary position. A barrier is provided and is movable between a blocking position and a release position. In the blocking position, the barrier prevents relative rotation between the first and second rotary members past the second rotary position. In the release position, the barrier permits relative rotation between the first and second rotary members past the second rotary position to the third rotary position. A barrier biasing member is provided and urges the barrier from a first of the blocking and release positions towards a second of the blocking and release positions, and a barrier holder that is movable between a holding position in which the barrier holder holds the barrier in the first of the blocking and release positions and a travel position in which the barrier holder permits movement of the barrier from the first of the blocking and release positions to the second of the blocking and release positions.

Other technical advantages may become readily apparent to one of ordinary skill in the art after review of the following figures and description.

BRIEF DESCRIPTIONS OF THE DRAWINGS

For a better understanding of the embodiment(s) described herein and to show more clearly how the embodiment(s) may be carried into effect, reference will now be made, by way of example only, to the accompanying drawings.

Figure 1:
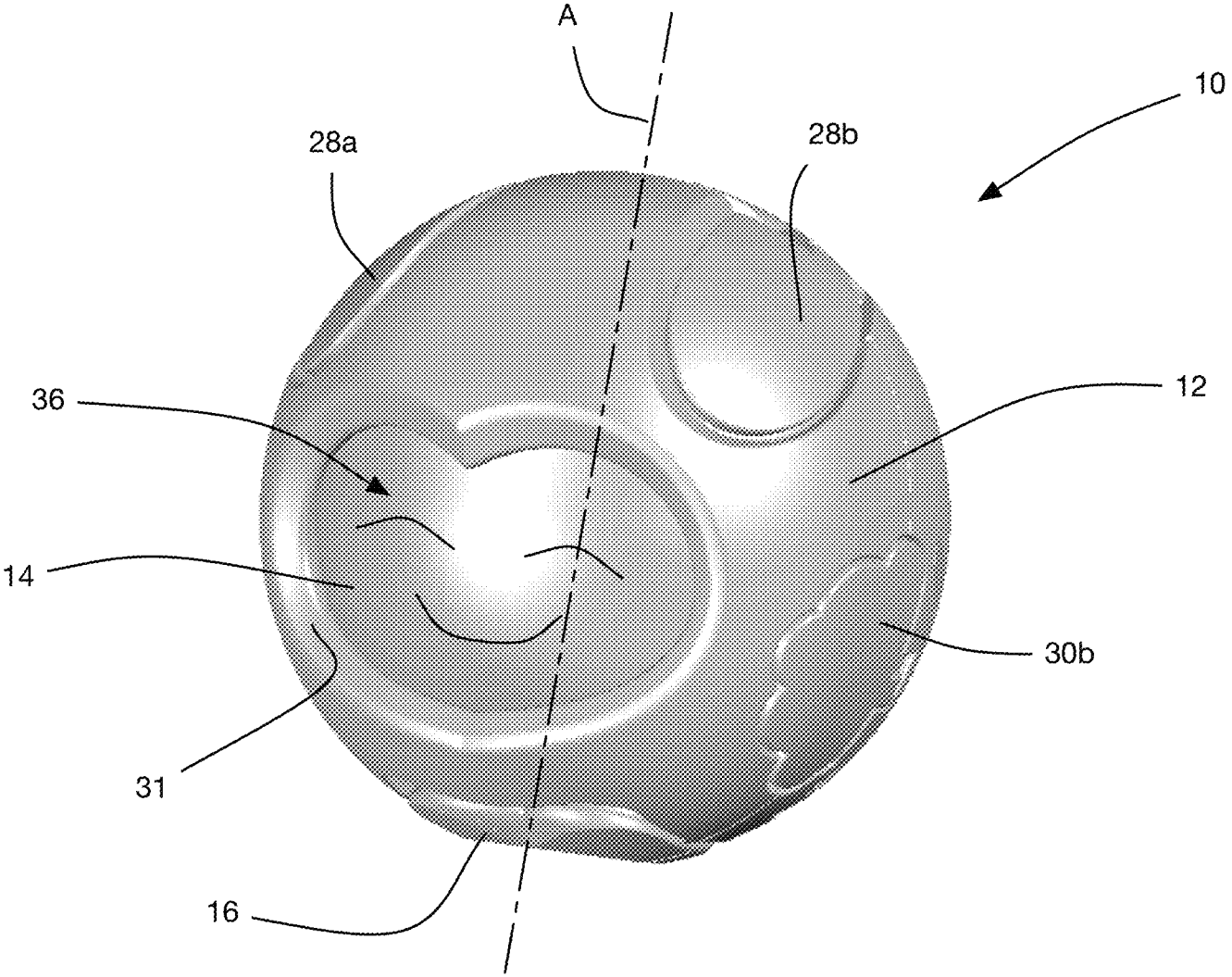
FIG. 1 shows a perspective view of a transformable toy in accordance with an embodiment of the present disclosure in a first state.

Unless otherwise specifically noted, articles depicted in the drawings are not necessarily drawn to scale.

DETAILED DESCRIPTION

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa;

similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. Furthermore, the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Reference is made to FIG. 1, which shows a transformable toy 10 in accordance with an embodiment of the present disclosure. The transformable toy 10 is positionable in a first state shown in FIG. 1, a second state shown in FIG. 2, and a third state shown in FIG. 3. In the first state, the transformable toy 10 may be rollable on a support surface G shown in FIG. 10. Furthermore, the transformable toy 10 may be in the form of a rollable character in the first state. In the second state, the transformable toy 10 may be in the form of an animal character. In the third state, the transformable toy 10 may be in the form of a human character. It will be noted that the transformable toy 10 could be in any form in any of the three states and that the three states described above are only non-limiting examples.

The transformable toy 10 includes a first rotary member 12, a second rotary member 14, and a projection member 16. In the embodiment shown, the transformable toy 10 optionally further includes a main biasing member 17, a helical guide 18, a helical guide follower 20, a barrier 22, a barrier biasing member 24, a latch member 26, and a plurality of flip up appendages 28*a*, 28*b*, 30*a* and 30*b*. For example, the transformable toy 10 could, for example, include the helical guide 18 and the helical guide follower 20, but could include none, some or all of the other optional components. The transformable toy 10 could, for example, include the barrier 22 and the barrier biasing member 24, but could include none, some or all of the other optional components. The transformable toy 10 could, for example, include the latch member 26, but could include none, some or all of the other optional components. In another, non-limiting, example, the transformable toy 10 could include none of the optional components noted above.

Figure 3:
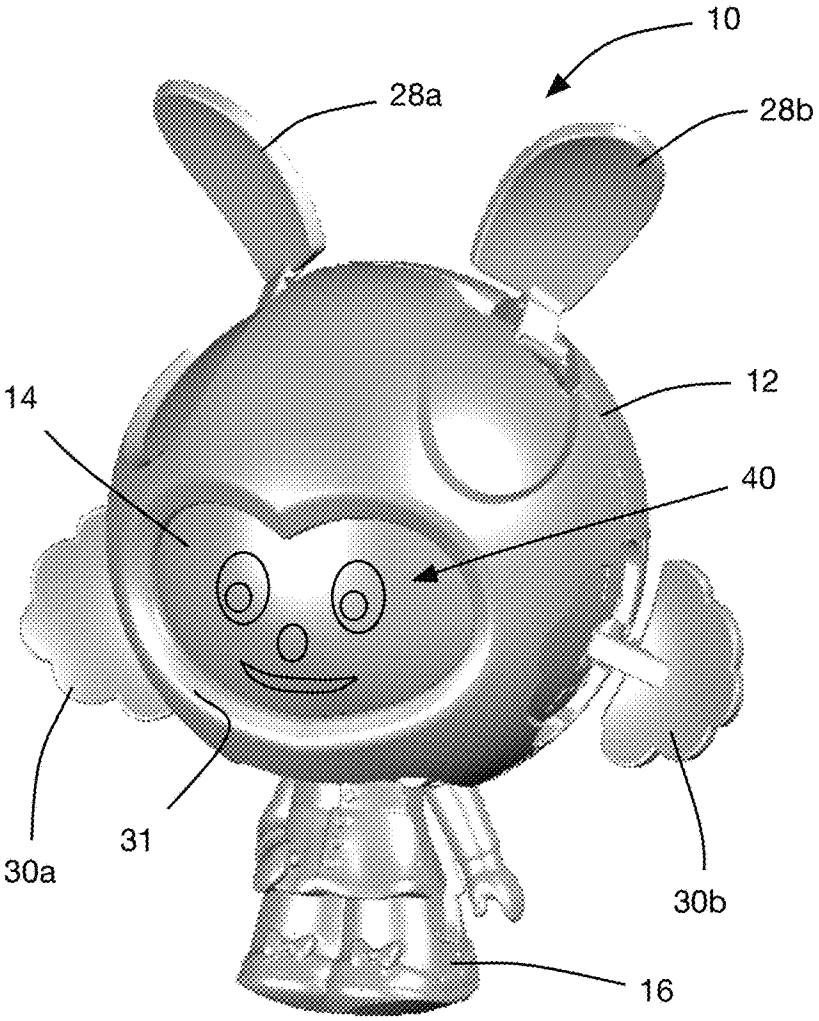
FIG. 3 shows a perspective view of the transformable toy shown in FIG. 1 in a third state.

The first and second rotary members 12 and 14 are rotatable relative to one another (about an axis A) between a first rotary position (FIG. 1) and a second rotary position (FIG. 2), and optionally may be further rotatable relative to one another between the second rotary position and a third rotary position (FIG. 3).

In the embodiment shown, the first rotary member 12 is an outer rotary member and the second rotary member 14 is an inner rotary member, wherein a portion of the inner rotary member is visible through the outer rotary member. In the example shown, a pass-through aperture 31 is provided in the first rotary member 12 for this purpose. Alternatively a transparent or semi-transparent window could be provided which permits the second (inner) rotary member 14 to be visible through the first (outer) rotary member 12. In other embodiments, the rotary member 14 may be considered to the first rotary member and the rotary member 12 may be considered to be the second rotary member, in which case the first rotary member 14 would be the inner rotary member and the second rotary member 12 would be the outer rotary member.

Figure 4:
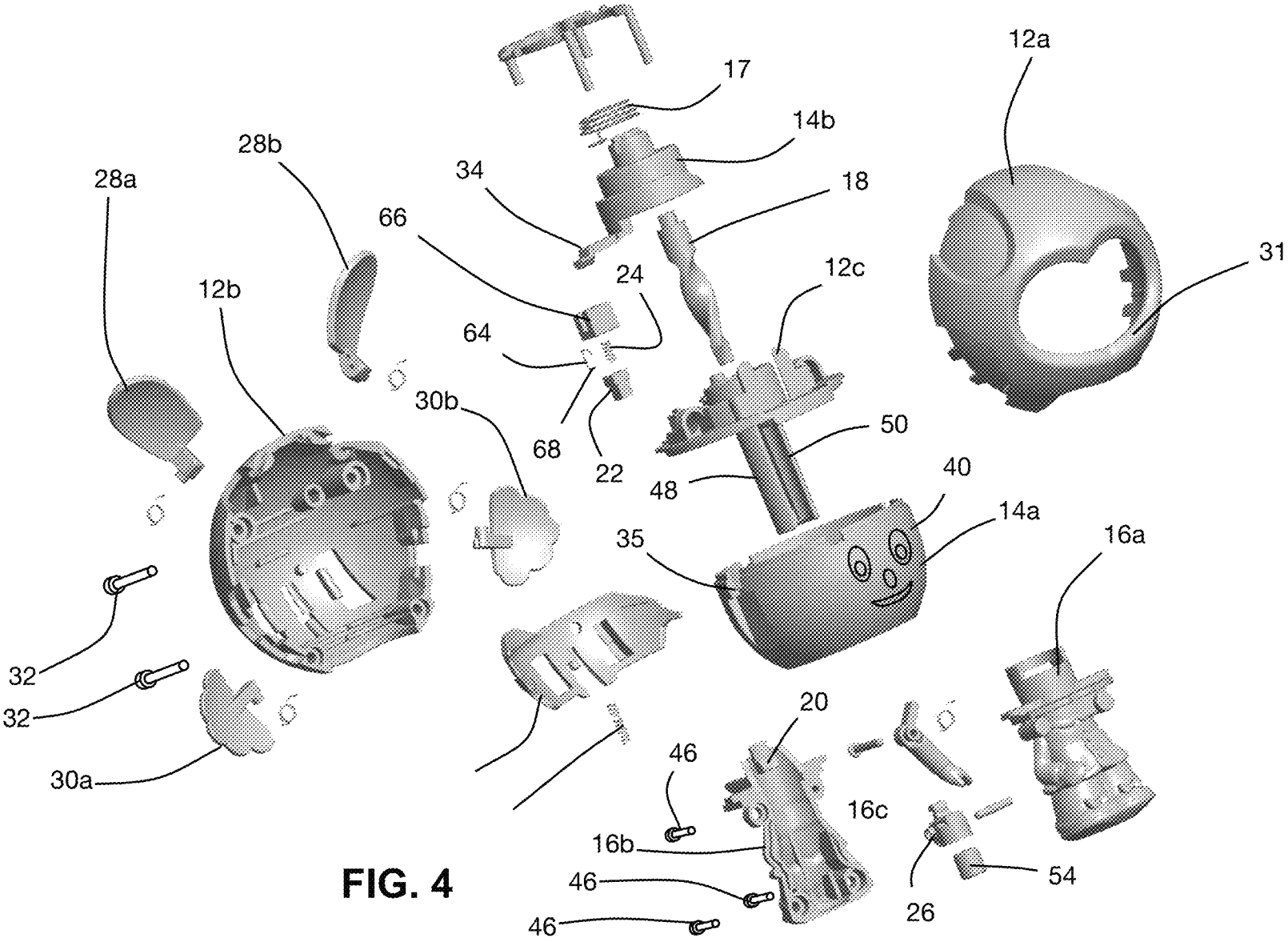
FIG. 4 is a perspective exploded view of the transformable toy shown in FIG. 1.

As can be seen in FIG. 4, the first rotary member 12 includes a first portion 12*a*, a second portion 12*b* and a third portion 12*c*, which are all connected together in any suitable way, such as via mechanical fasteners shown at 32.

The second rotary member 14 includes a first portion 14*a* and a second portion 14*b*. The second portion 14*b* of the second rotary member 14 and the first portion 14*a* of the second rotary member 14 are rotationally connected to one another by means of a drive arm 34 that extends from the second portion 14*b* of the second rotary member 14 and fits in a drive slot 35 on the first portion 14*a* of the second rotary member 14. It will be noted that the drive arm 34 and the drive slot 35 permits the first and second portions 14*a* and 14*b* to be rotationally connected to one another, while permitting relative movement axially between the first and second portions 14*a* and 14*b*.

Figure 2:
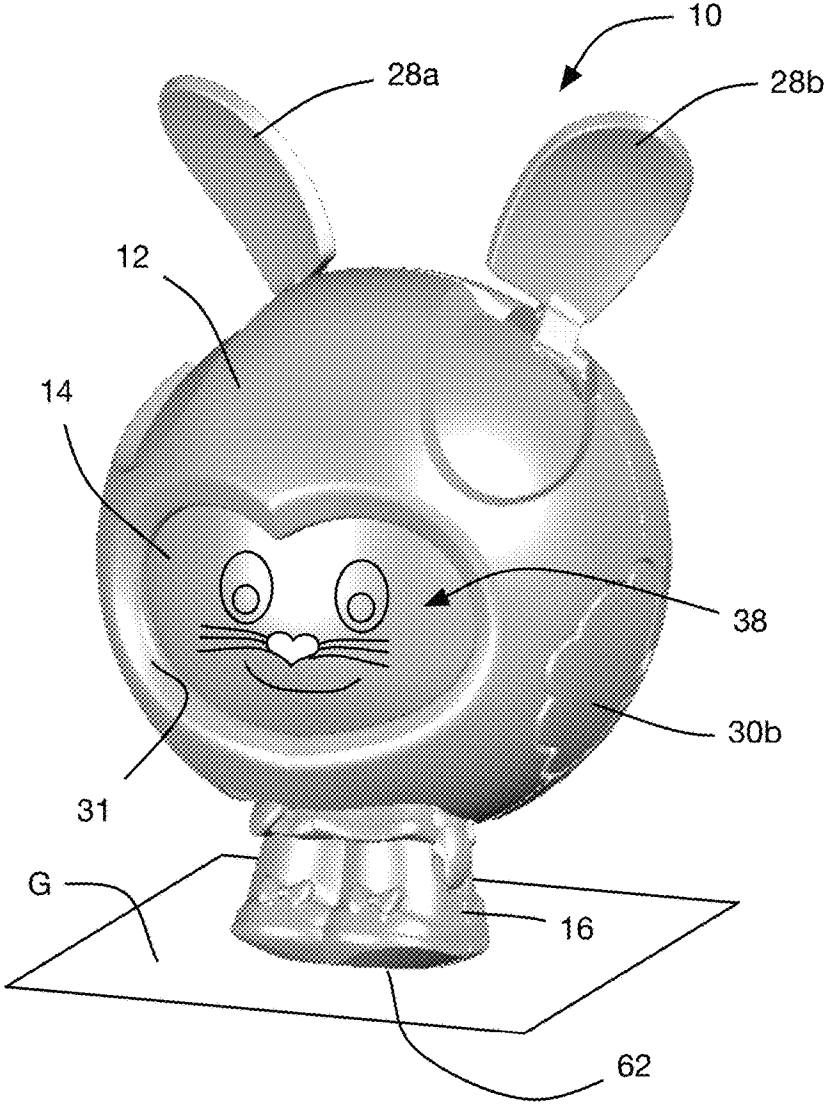
FIG. 2 shows a perspective view of the transformable toy shown in FIG. 1 in a second state.

The second rotary member 14 may include first indicia 36 (FIG. 1), and second indicia 38 (FIG. 2), and may include third indicia 40 (FIG. 3), in embodiments wherein there is a third rotary position. The first indicia 36 may be first facial features representing a first facial expression, and are visible when the first and second rotary members 12 and 14 are in the first rotary position, as shown in FIG. 1. In this example, the first facial features represent a smiling face with its eyes closed. The second indicia 38 may be second facial features representing a second facial expression, and are visible when the first and second rotary members 12 and 14 are in the second rotary position, as shown in FIG. 2. In this example, the second indicia may be positioned about 90 degrees angularly away from the first indicia 36 on the second rotary member 14. In this example, the second facial features represent a smiling animal caricature face with its eyes open. The third indicia 40 may be third facial features representing a third facial expression, and are visible when the first and second rotary members 12 and 14 are in the third rotary position, as shown in FIG. 3. In this example, the third facial features represent a smiling person's caricature face with its eyes open.

The main biasing member 17 (FIGS. 4 and 5) is positioned to urge the first and second rotary members 12 and 14 towards the second rotary position. It will be noted that, in the embodiment shown, in which the first and second rotary members 12 and 14 are positionable in the third rotary position, the main biasing member 17 also may be said to be positioned to urge the first and second rotary members towards the third rotary position. For example, when the first and second rotary members 12 and 14 are between the first and second rotary positions, the main biasing member 17 may be said to be positioned to urge the first and second rotary members towards the second rotary position (or may also be said to urge the rotary members towards the third rotary position).

Figure 5:
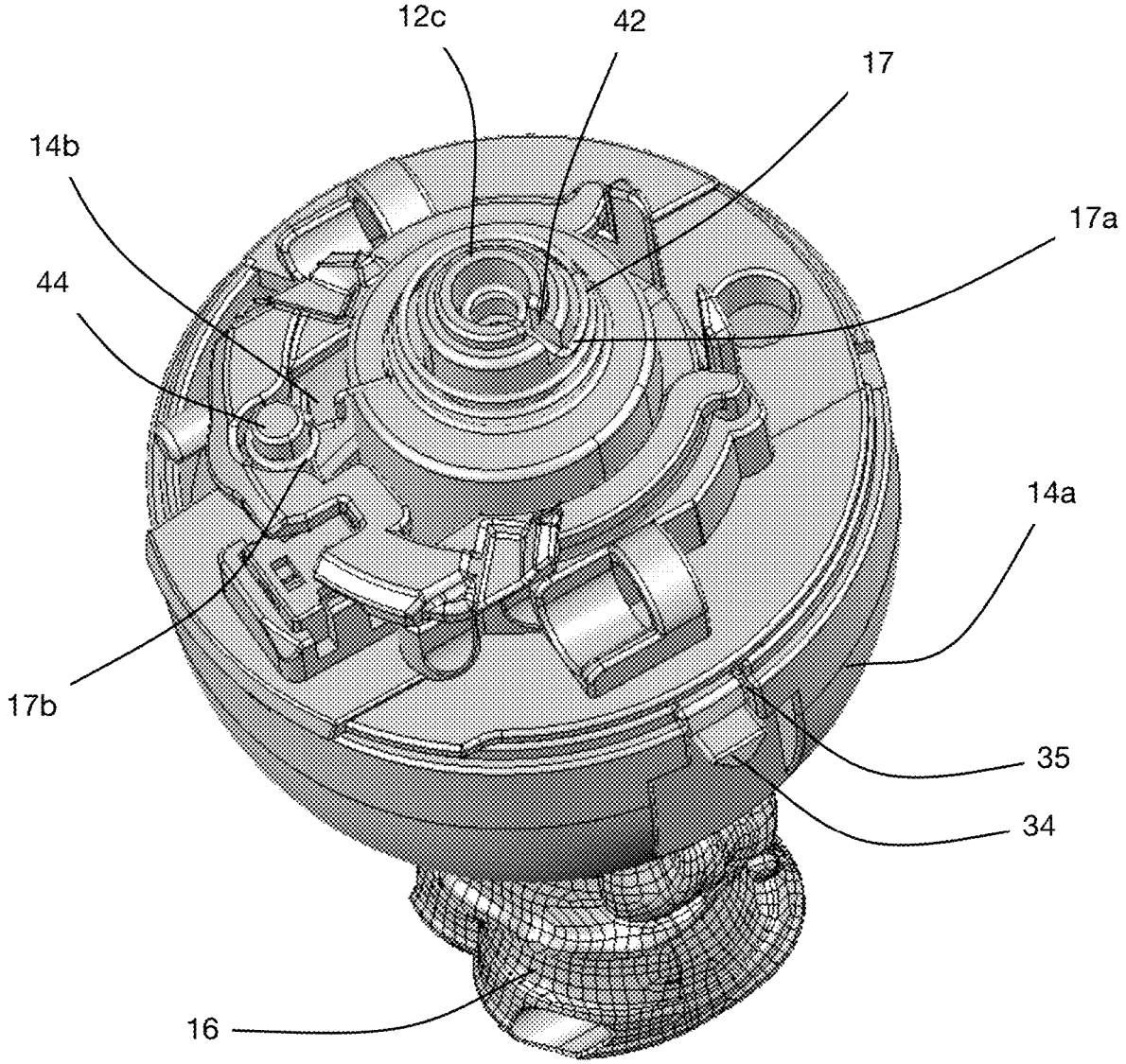
FIG. 5 is a perspective view of the transformable toy shown in FIG. 1, with some elements removed.

The main biasing member 17 may be, for example, a torsion spring, as shown in FIGS. 4 and 5, that has a first torsion spring end 17*a* (FIG. 5) that is connected to the first rotary member 12 and a second torsion spring end 17*b* that is connected to the second rotary member 14. More specifically, in the example shown, the first torsion spring end 17*a* is connected to the third portion 12*c* of the first rotary member 12 by passing through a slot 42 therein and the second torsion spring end 17*b* is connected to the second portion 14*b* of the second rotary member 14 by engagement about a post 44 thereon.

The projection member 16 is rotationally fixed to the first rotary member 12, and is movable between a retracted position (FIG. 1) and an extended position (FIG. 2) relative to the first rotary member 12. In embodiments wherein the first and second rotary members 12 and 14 are movable to a third rotary position, the extended position shown in FIG. 2 for the projection member 16 is a first extended position, and the projection member 16 is further movable between the first extended position of FIG. 2 and a second extended position (FIG. 3) relative to the first rotary member 12. As can be seen, in the example shown, the projection member 16 extends farther out from the first rotary member 12 when in the second extended position, then when it is in the first extended position, and farther out from the first rotary member 12 when in the first extended position, then when in the retracted position. For greater certainty, it will be understood that, in the retracted position, the projection member 16 need not be retracted completely into the first rotary member 12. For example, in the embodiment shown, some of the projection member 16 extends out slightly from the first rotary member 12. In other embodiments, however, it is possible for the projection member 16 to be completely retracted within the first rotary member 12, when in the retracted position.

The projection member 16 may be made from a plurality of components, including a first portion 16*a* and a second portion 16*b* that may be connected together by any suitable way, such as by mechanical fasteners 46. The projection member 16 may represent a body of the character who's head is represented by the first and/or second rotary member 12 and 14. The first portion 16*a* may be a front part of the body, while the second portion 16*b* may be a rear part of the body.

Relative rotation between the first and second rotary members 12 and 14 between the first and second rotary positions, drives movement of the projection member 16 between the retracted and extended positions. If the first and second rotary members 12 and 14 are movable to the third rotary position, then relative rotation between the first and second rotary members 12 and 14 between the first and second rotary positions, drives movement of the projection member 16 between the first extended and second extended positions.

In embodiments in which the helical guide 18 and the helical guide follower 20 are provided, such as the embodiment that is shown, the helical guide 18 and the helical guide follower 20 link relative rotational movement between the first and second rotary members 12 and 14 with extension and retraction of the projection member 16 relative to the first rotary member 12.

Figure 6:
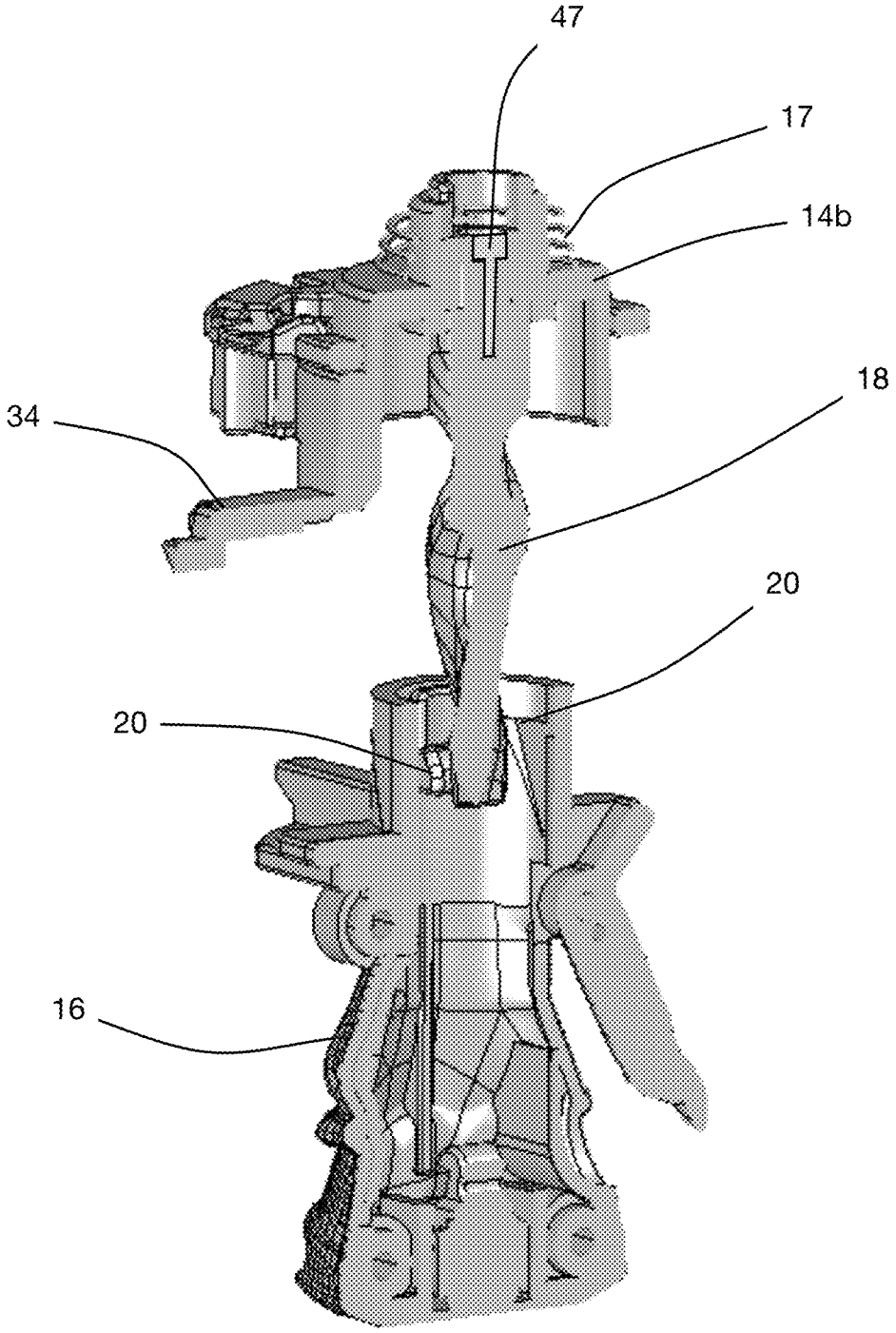
FIG. 6 is a perspective of the transformable toy shown in FIG. 1 showing a helical guide member.
Figure 7:
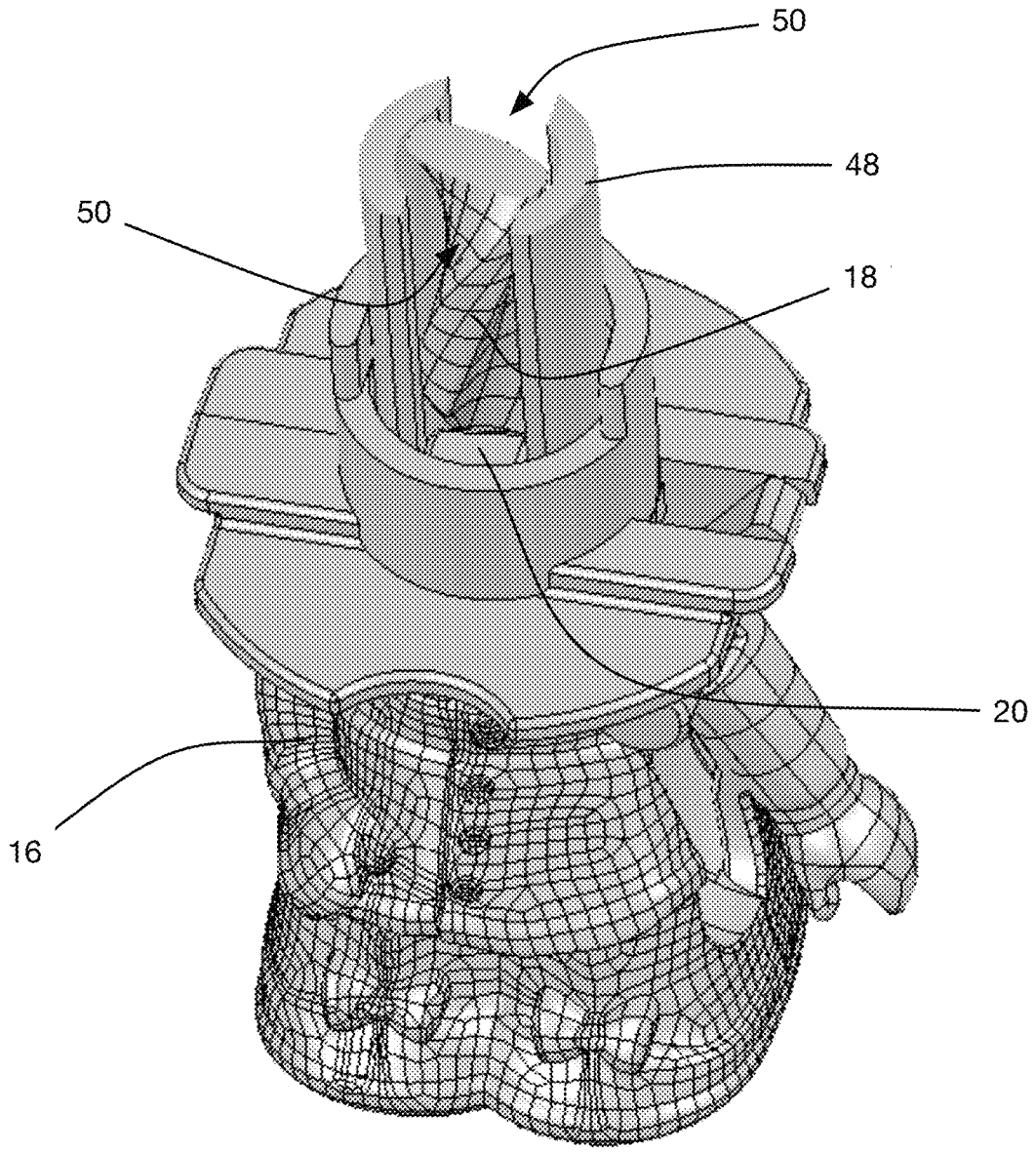
FIG. 7 is a perspective of the transformable toy shown in FIG. 1 showing the helical guide member and a helical guide follower.

In some embodiments, the helical guide 18 is connected to one of the second rotary member 14 and the projection member 16, and the helical guide follower 20 is connected to the projection member 16. In the example embodiment shown, (see FIG. 6), the helical guide 18 is connected to the second rotary member 14 (e.g. to the second portion 14*b* of the second rotary member 14 by means of a mechanical fastener 47) and the helical guide follower 20 is a first of two helical guide followers 20 (FIG. 7), which are connected respectively to the first and second portions 16*a* and 16*b* of the projection member 16.

Furthermore, as can be seen in FIG. 4, the first rotary member 12 (specifically the third portion 12*c* of the first rotary member 12) may have a linear movement guide 48 that includes a follower constraint slot 50 for each helical guide follower 20 that is provided. In the present embodiment, there are two follower constraint slots 50, each of which constrains one of the two helical guide followers 20 to move axially while engaged with the helical guide member 18. The follower constraint slots 50 and the helical guide followers 20 may be what rotationally fix the projection member 16 to the first rotary member 12.

As a result of this arrangement, relative rotation between the first rotary member 12 and the second rotary member 14 between the first and second rotary positions drives relative rotation between the helical guide 18 and the helical guide follower 20, which in turn drives the projection member 16 to move between the retracted and extended positions.

Figure 8:
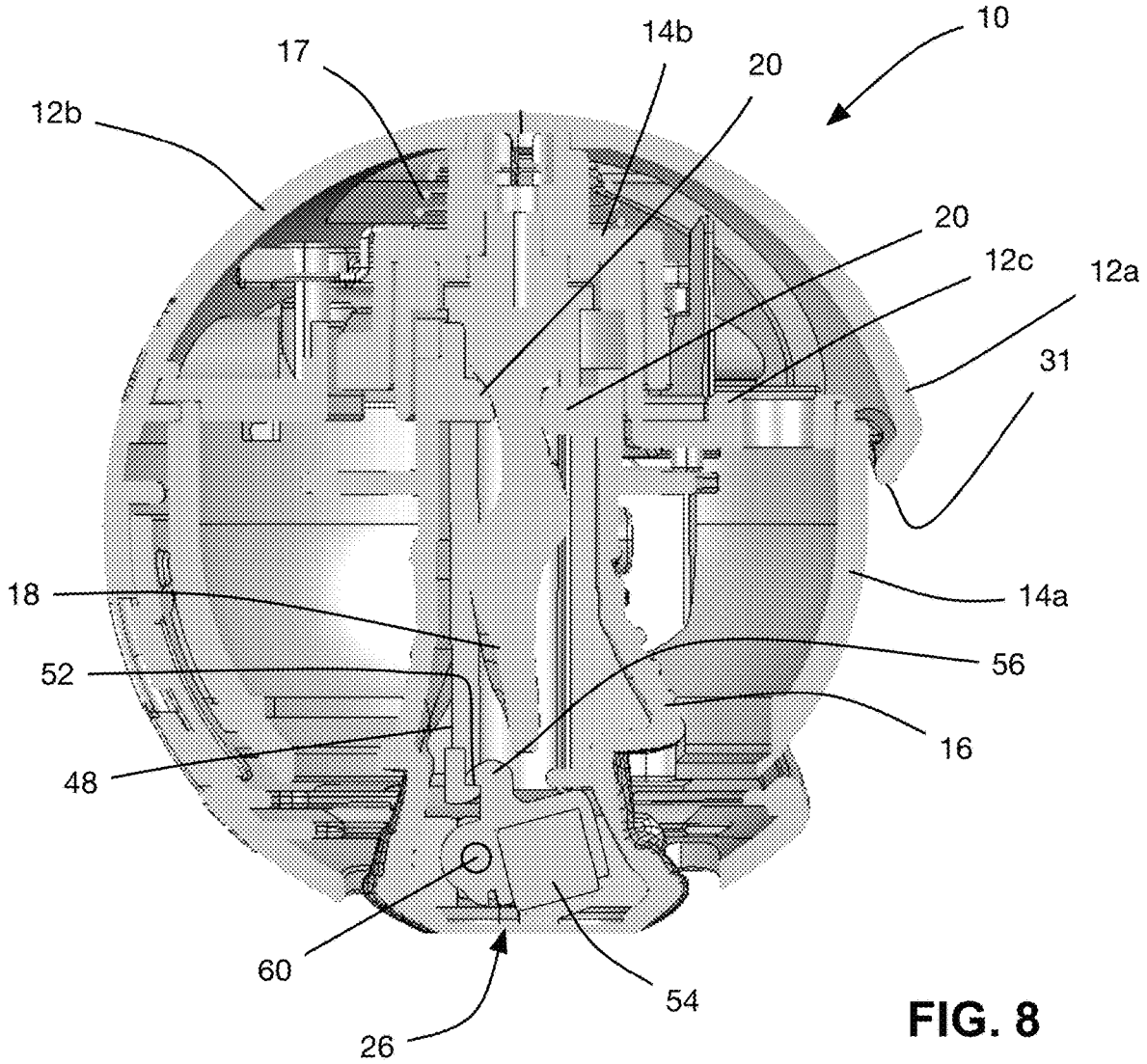
FIG. 8 is a sectional side view of the transformable toy shown in FIG. 1 in the first state showing a magnetic latch member in a latching position.
Figure 9:
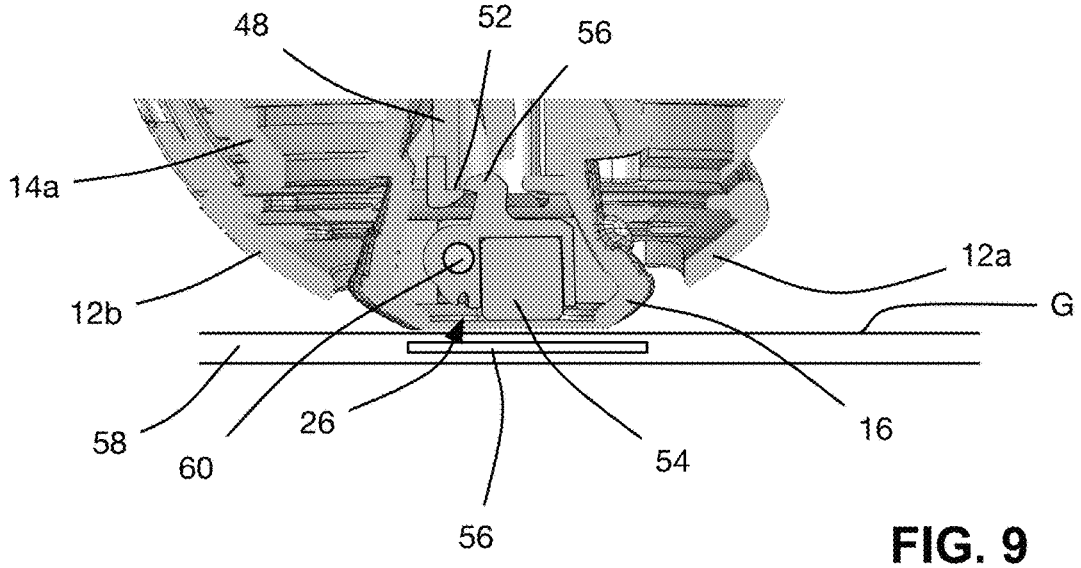
FIG. 9 is a sectional side view of a portion of the transformable toy shown in FIG. 1 in the first state showing the magnetic latch member in a release position.

The latch member 26 is used to hold the transformable toy 10 in the first state. The latch member 26 is movable between a latching position (FIG. 8) and an unlatching position (FIG. 9). In the latching position, the latch member 26 is engageable with a latching shoulder 52 to prevent movement of the projection member 16 towards one of the extended and retracted positions. In the unlatching position the latch member 26 permits movement of the projection member 16 towards the extended position. The latch member 26 includes a first magnetically-interactive member 54 and is positioned to move to the unlatching position upon approach of the transformable toy 10 with a second magnetically-interactive member (shown at 56 in FIG. 9) that is external to the transformable toy 10. The latch member 26 further includes a hook portion 56 that is engageable with the latching shoulder 52.

A magnetically-interactive member (such as the first and second magnetically-interactive members 54 and 56) is a member that is caused to move in the presence of a magnet. Thus, a magnetically-interactive member could be a piece of ferromagnetic material, or for example, it could be a magnet itself. It will be understood that at least one of the first and second magnetically-interactive members 54 and 56 would be a magnet, while the other of the first and second magnetically-interactive members 54 and 56 may be a magnet, or may be an object that interacts with a magnet, such as a ferromagnetic member. In the example shown, the first magnetically-interactive member 54 is a magnet, and the second magnetically-interactive member 56 is a piece of ferromagnetic material, such as steel, that is embedded in a platform member 58 whose upper surface is the support surface G.

In order to hold the transformable toy 10 in the first position, the latch member 26 and the latching shoulder 52 may be provided on any suitable combination of elements. For example, in the embodiment shown, the latch member 26 is connected to the projection member 16, and the latching shoulder 52 is connected to the first rotary member 12 (specifically to the linear movement guide 48). In another embodiment, the latch member 26 may be connected to the first rotary member 12, and the latching shoulder 52 may be connected to the second rotary member 14 in order to prevent relative rotation therebetween. In yet another embodiment, the latch member 26 may be connected to the second rotary member 12, and the latching shoulder 52 may be connected to the projection member 16 in order to prevent relative linear movement therebetween. Since the movement between the first rotary member 12, the second rotary member 14 and the projection member 16 are all interconnected, the latch member 26 and the latching shoulder 52 may be provided on any combination of two of these three elements.

The latch member 26 may be pivotably connected (e.g. via a pin joint 60) to whatever component it is connected to (e.g. the projection member), so as to be pivotably movable between the latching and unlatching positions.

Figure 10:
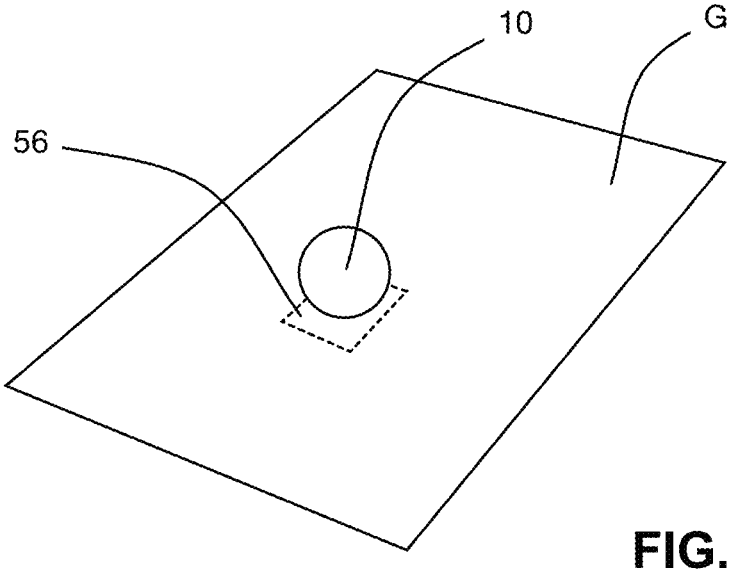
FIG. 10 is a perspective side view of the transformable toy shown in FIG. 1 rolling on a support surface.

In the embodiment shown, when the projection member 16 is in the retracted position (FIG. 1), the transformable toy 10 is rollable on the support surface G (optionally with the intent of trying to get the transformable toy 10 to roll over the second magnetically-interactive member 56, as illustrated in FIG. 10, while oriented so that the first magnetically-interactive member 54 is sufficiently close to the second magnetically-interactive member 56 to cause the unlatching of the latch member 26). and when the projection member is in the extended position (FIG. 2), the projection member 16 has a ground engagement surface 62 (FIG. 9) and may optionally positioned to solely support the transformable toy 10 on the support surface G via the ground engagement surface 62 (FIG. 2).

Figure 11:
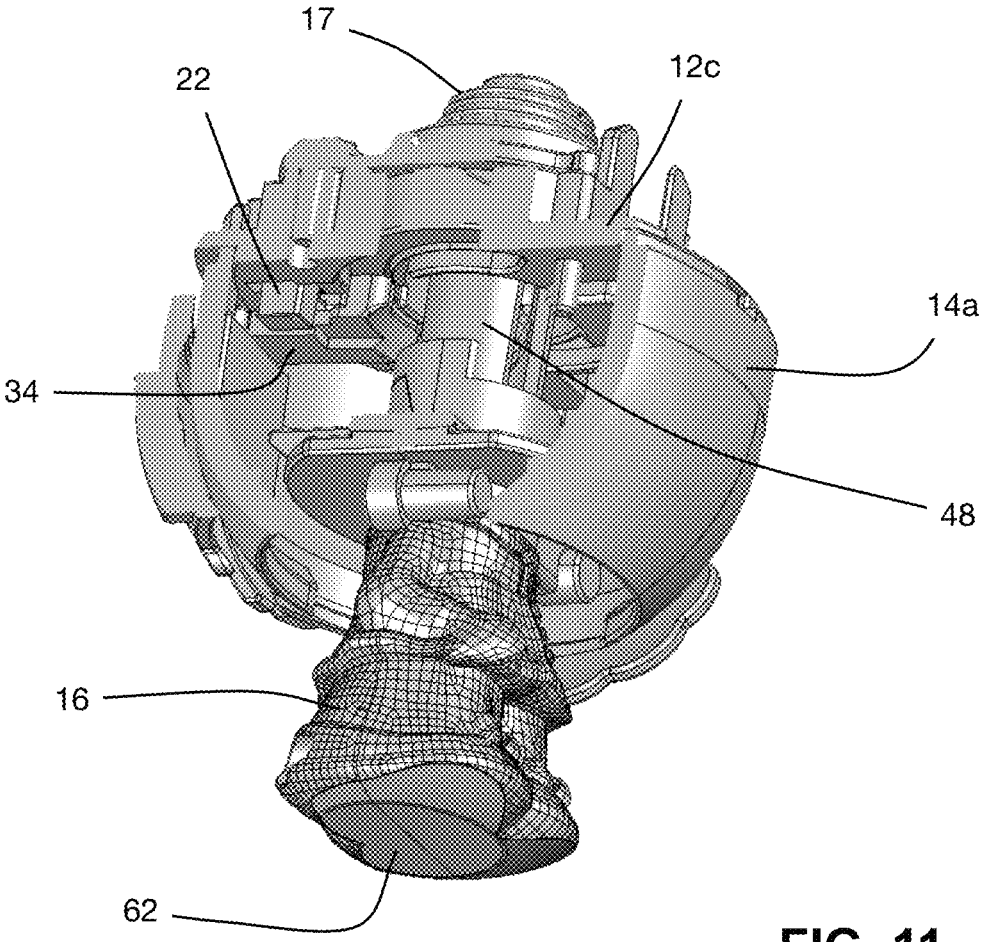
FIG. 11 is a perspective sectional view of the transformable toy shown in FIG. 1 showing a movable barrier in a blocking position.
Figure 12:
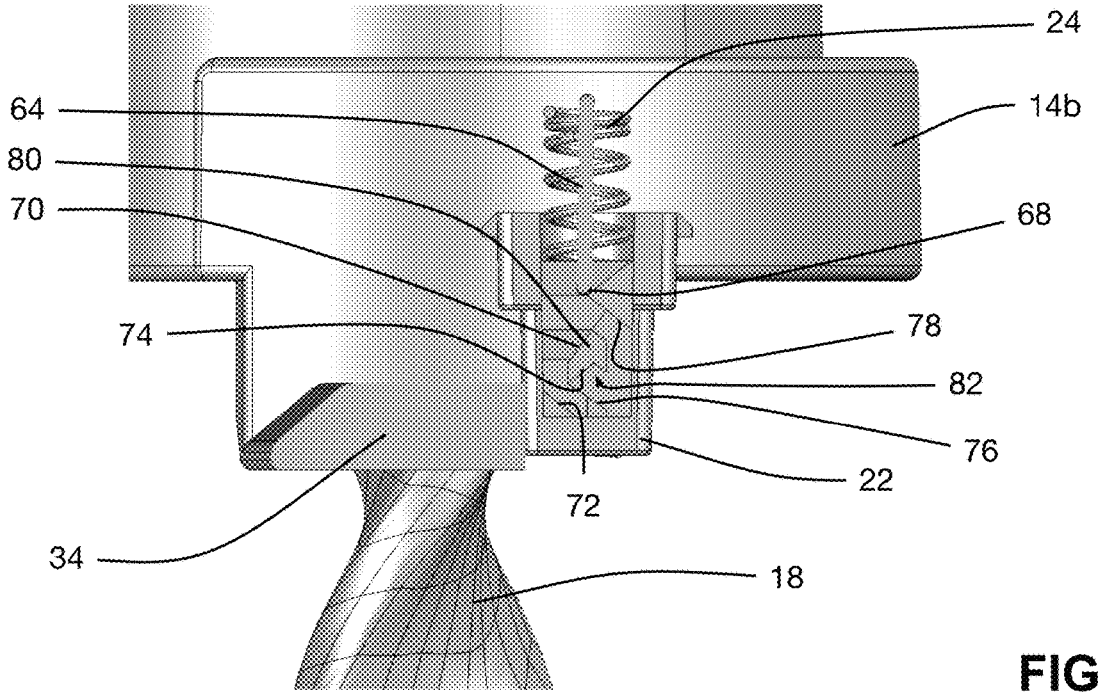
FIG. 12 is a side view of a portion of the transformable toy shown in FIG. 1 showing the movable barrier in the blocking position.
Figure 13:
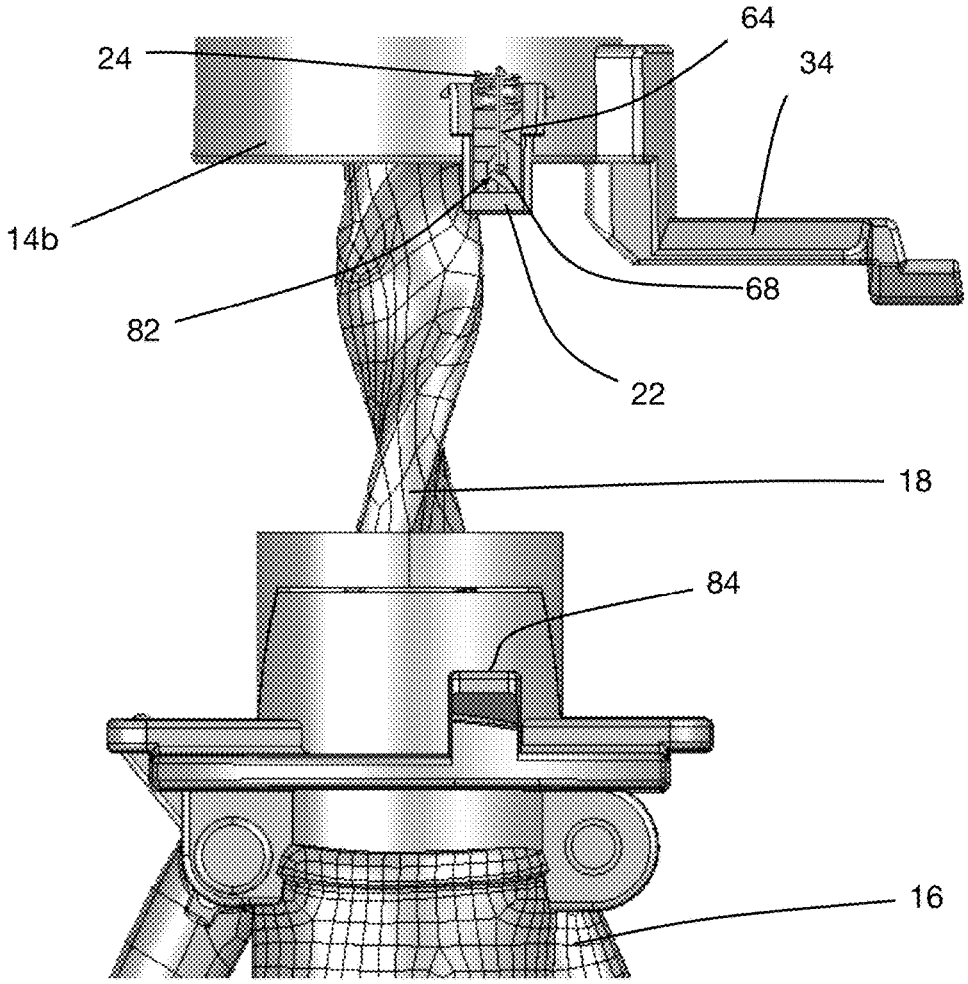
FIG. 13 is a side view of a portion of the transformable toy shown in FIG. 1 showing the movable barrier in a release position.

The optionally provided barrier 22 is movable between a blocking position shown in FIGS. 11 and 12, and a release position shown in FIG. 13. In the blocking position, the barrier 22 prevents relative rotation between the first and second rotary members 12 and 14 past the second rotary position (FIGS. 2, 11 and 12) and movement of the projection member past the first extended position (FIGS. 2 and 11). In the release position, the barrier 22 permits relative rotation between the first and second rotary members 12 and 14 past the second rotary position to the third rotary position (FIGS. 3 and 13) and movement of the projection member 16 past the first extended position to the second extended position (FIGS. 3 and 13).

The barrier biasing member 24 urges the barrier 22 from a first of the blocking and release positions towards a second of the blocking and release positions. In the example embodiment shown, the barrier biasing member 24 urges the barrier 22 towards the blocking position. In the embodiment shown, the barrier biasing member 24 is a helical compression spring but could be any other suitable type of biasing member.

A barrier holder 64 may be provided and is movable between a holding position (FIG. 13) in which the barrier holder 64 holds the barrier 22 in the first of the blocking and release positions (in the example shown, the release position) against a biasing force applied by the barrier biasing member 24, and a travel position (FIG. 12) in which the barrier holder 64 permits movement of the barrier 22 from the first of the blocking and release positions to the second of the blocking and release positions (in the example shown, movement from the release position to the blocking position).

In the example, shown, the barrier holder 64 is a resilient member that is fixedly held in a barrier housing 66 (FIG. 4). The barrier housing 66 may be fixedly mountable to the third portion 12*c* of the first rotary member 12. The barrier holder 64 has an engagement end 68 that is best seen in FIG. 4 but which is identified in FIGS. 12 and 13 even though it is somewhat obscured by the rest of the barrier holder 64.

The barrier 22 itself includes several barrier holder guide surfaces shown at 70, 72, 74, 76, and 78. When the barrier 22 is in the blocking position of FIG. 12 and is pushed in a first direction (e.g. upwards in the view shown in FIG. 12, towards its release position), it will drive the first barrier holder guide surface 72 into engagement with the barrier holder 64, which will drive the engagement end of the barrier holder towards the left in the view shown in FIG. 12. Further movement of the barrier 22 in the first direction will then bring the engagement end 68 around the locking projection shown at 80 (which has some of the aforementioned guide surfaces on it). Further movement of the barrier 22 in the selected direction will bring the engagement end 68 into engagement with the second barrier holder guide surface 72, which urges the engagement end 68 back towards a neutral position. Releasing the barrier 22 at this point, permits the barrier biasing member 24 to urge the barrier in a second direction opposite the first direction. This brings the engagement end 68 into engagement with the third barrier holder guide surface 74. Further movement of the barrier 22 in the second direction brings the engagement end 68 into engagement with a locking notch shown at 82 (i.e. the position shown in FIG. 13), at which point the barrier 22 is in the release position.

When the barrier 22 is in the release position as shown in FIG. 13, and is pushed in the first direction again (i.e. upwards in the view shown in FIG. 13), the fourth barrier holder guide surface 76 is brought into engagement with the barrier holder 64 (i.e. with the engagement end 68), which guides the engagement end 68 over to the right of the locking projection 80. Release of the barrier 22 at this point, then permits the barrier biasing member 24 to drive the barrier 22 in the second direction (i.e. downward in the view shown), at which point the engagement end 68 passes around the right side of the locking projection 80, and engages the fifth barrier holder guide surface 78, which guides the engagement end 68 back towards the neutral position shown in both FIGS. 12 and 13 (i.e. a generally centered position).

Figure 14:
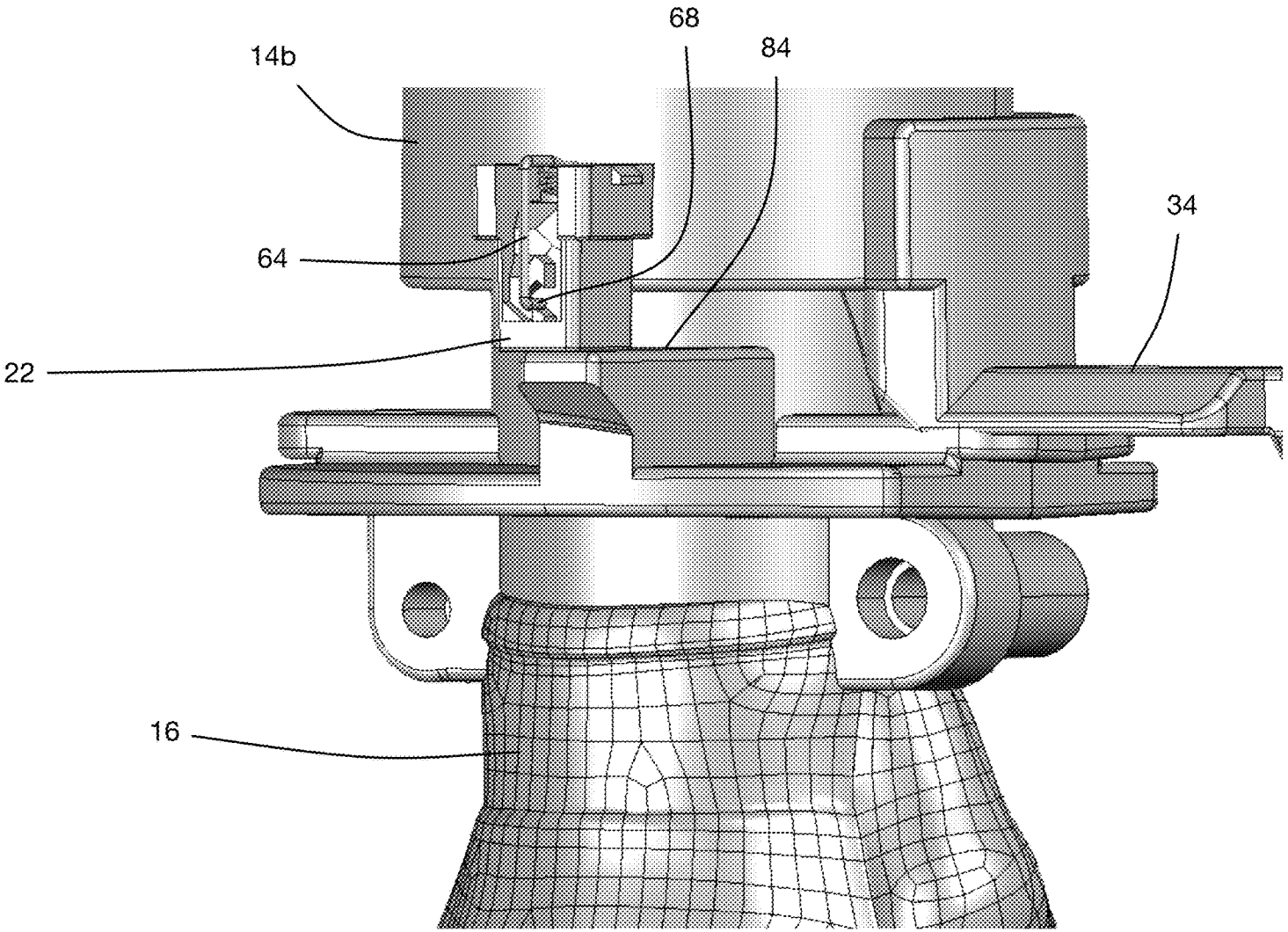
FIG. 14 is a perspective view of a portion of the transformable toy shown in FIG. 1 with the barrier being actuated to change position.

In order to actuate the barrier 22 to move it between the blocking and release positions, an actuation surface 84 may be provided on the projection member 16 (FIGS. 13 and 14). The user can push down on the first and second rotary members 12 and 14 to cause retraction of the projection member 16 into the first rotary member 12, which brings the actuation surface 84 upwards into engagement with the barrier 22 (FIG. 14), thereby toggling the barrier 22 to the other of whichever of the blocking and release positions it is in.

The main biasing member 17 then urges the first and second rotary members 12 and 14 back towards whichever rotational position they can reach depending on whether the latch member 26 is engaged with the latching shoulder 52, and depending on the position of the barrier 22 after it has been actuated.

The appendages 28*a* and 28*b* and 30*a* and 30*b* may be actuated to flip up via biasing members (e.g. torsion springs) as needed.

For greater certainty, it will be noted that it is possible provide an embodiment of the transformable toy 10 that does not include a projection member but includes the first and second rotary members 12 and 14, which are movable between the first, second and third rotary positions and which employs the barrier 22 to block relative movement of the first and second rotary members 12 and 14 past the second rotary position.

Although specific advantages have been enumerated above, various embodiments may include some, none, or all of the enumerated advantages.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A transformable toy, comprising:

a first rotary member and a second rotary member, wherein the first and second rotary members are rotatable relative to one another between a first rotary position and a second rotary position;

a projection member that is rotationally fixed to the first rotary member, and is movable between a retracted position and an extended position relative to the first rotary member; and a helical guide that is connected to one of the second rotary member and the projection member, and a helical guide follower that is connected to the other of the second rotary member and the projection member, wherein relative rotation between the first rotary member and the second rotary member between the first and second rotary positions drives relative rotation between the helical guide and the helical guide follower, which in turn drives the projection member to move between the retracted and extended positions, wherein the first rotary member is an outer rotary member, and the second rotary member is an inner rotary member, wherein a portion of the inner rotary member is visible through the outer rotary member, wherein the inner rotary member includes first indicia and second indicia, wherein the first indicia are visible through the outer rotary member when the outer and inner rotary members are in the first rotary position and the second indicia are visible through the outer rotary member when the outer and inner rotary members are in the second rotary position.

2. The transformable toy as claimed in claim 1, wherein the first indicia are first facial features representing a first facial expression, and the second indicia are second facial features representing a second facial expression.

3. The transformable toy as claimed in claim 1, wherein the first and second rotary members are further rotatable relative to one another between the second rotary position and a third rotary position, and wherein the extended position for the projection member is a first extended position, and wherein the projection member is further movable between the first extended position and a second extended position relative to the first rotary member, and wherein the transformable toy further comprises a barrier that is movable between a blocking position and a release position, wherein in the blocking position, the barrier prevents relative rotation between the first and second rotary members past the second rotary position and movement of the projection member past the first extended position, and wherein in the release position, the barrier permits relative rotation between the first and second rotary members past the second rotary position to the third rotary position and movement of the projection member past the first extended position to the second extended position.

4. The transformable toy as claimed in claim 3, wherein the first rotary member is an outer rotary member, and the second rotary member is an inner rotary member, wherein a portion of the inner rotary member is visible through the outer rotary member, wherein the inner rotary member includes first indicia, second indicia, and third indicia, wherein the first indicia are visible through the outer rotary member when the outer and inner rotary members are in the first rotary position, the second indicia are visible through the outer rotary member when the outer and inner rotary members are in the second rotary position, and the third indicia are visible through the outer rotary member when the outer and inner rotary members are in the third rotary position.

5. The transformable toy as claimed in claim 4, wherein the first indicia are first facial features representing a first facial expression, the second indicia are second facial features representing a second facial expression, and the third indicia are third facial features representing a third facial expression.

6. The transformable toy as claimed in claim 3, further comprising a barrier biasing member that urges the barrier from a first of the blocking and release positions towards a second of the blocking and release positions, and a barrier holder that is movable between a holding position in which the barrier holder holds the barrier in the first of the blocking and release positions and a travel position in which the barrier holder permits movement of the barrier from the first of the blocking and release positions to the second of the blocking and release positions.

7. The transformable toy as claimed in claim 6, wherein the barrier biasing member urges the barrier towards the blocking position and the barrier holder holds the barrier in the release position against a biasing force applied by the barrier biasing member.

8. The transformable toy as claimed in claim 1, further comprising a main biasing member that is positioned to urge the first and second rotary members towards the second rotary position and to urge the projection member towards the extended position.

9. The transformable toy as claimed in claim 8, wherein the main biasing member is a torsion spring that has a first torsion spring end that is connected to the first rotary member and a second torsion spring end that is connected to the second rotary member.

10. The transformable toy as claimed in claim 8, further comprising a latch member that is movable between a latching position and an unlatching position, wherein, in the latching position, the latch member is engageable with a latching shoulder to prevent movement of the projection member towards one of the extended and retracted positions, and wherein in the unlatching position the latch member permits movement of the projection member towards the extended position, wherein the latch member includes a first magnetically-interactive member and is positioned to move to the unlatching position upon approach of the transformable toy with a second magnetically-interactive member that is external to the transformable toy, wherein at least one of the first and second magnetically-interactive members is a magnet.

11. The transformable toy as claimed in claim 1, wherein, when the projection member is in the retracted position, the transformable toy is rollable on a support surface, and when the projection member is in the extended position, the projection member has a ground engagement surface and is positioned to solely support the transformable toy on the support surface via the ground engagement surface.

* * * * *